US008066622B2

(12) United States Patent
Kim

(10) Patent No.: US 8,066,622 B2
(45) Date of Patent: Nov. 29, 2011

(54) COMPLEX BENCH PRESS

(76) Inventor: Seongil Kim, Gangwon-Do (KR)

( * ) Notice: Subject to any disclaimer, the term of this patent is extended or adjusted under 35 U.S.C. 154(b) by 0 days.

(21) Appl. No.: 12/997,245

(22) PCT Filed: Mar. 15, 2010

(86) PCT No.: PCT/KR2010/001583

§ 371 (c)(1),
(2), (4) Date: Dec. 9, 2010

(87) PCT Pub. No.: WO2010/104363

PCT Pub. Date: Sep. 16, 2010

(65) Prior Publication Data

US 2011/0082016 A1 Apr. 7, 2011

(30) Foreign Application Priority Data

Mar. 13, 2009 (KR) ..... 10-2009-0021638
Apr. 15, 2009 (KR) ..... 10-2009-0032930

(51) Int. Cl.
*A63B 21/00* (2006.01)

(52) U.S. Cl. ..... 482/94; 482/142; 482/130

(58) Field of Classification Search ..... 482/94, 482/142, 130, 112

See application file for complete search history.

(56) References Cited

U.S. PATENT DOCUMENTS

| | | | |
|---|---|---|---|
| 4,653,751 | A | 3/1987 | Green |
| 4,807,875 | A | 2/1989 | Tanski |
| 5,141,480 | A | 8/1992 | Lennox |
| 2005/0032614 | A1 | 2/2005 | Keiser |

FOREIGN PATENT DOCUMENTS

| | | |
|---|---|---|
| KR | 10-1995-0001891 | 3/1995 |
| KR | 20-2002-0006738 | 7/2002 |
| KR | 20-2003-0002197 | 4/2003 |
| KR | 20-0380503 | 3/2005 |

OTHER PUBLICATIONS

International Search Report PCT/KR2010/001583 mailed Nov. 2, 2010.

*Primary Examiner* — Jerome W Donnelly
(74) *Attorney, Agent, or Firm* — Christopher Paul Mitchell

(57) ABSTRACT

Disclosed is a complex bench press which can be switched into a flat bench press, a decline bench press, or an incline bench press to achieve improved space utilization in a narrow space, and which enables users to switch the bench press into the bench press for a specific function in a significantly simple and quick manner to achieve improved convenience of use, and which enables users to always assume a posture appropriate for exercising even when the bench press is switched into the bench press for a specific function, to thereby protect users from injury during exercise.

8 Claims, 10 Drawing Sheets

COMPLEX BENCH PRESS

RELATED APPLICATIONS

This application is a 371 application of International Application No. PCT/KR2010/001583, filed Mar. 15, 2010, which in turn claims priority from Korean Patent Application Nos. 10-2009-0021638, filed Mar. 13, 2009, and 10-2009-0032930, filed Apr. 15, 2009, each of which is incorporated herein by reference in its entirety.

TECHNICAL FIELD

The present invention relates to a bench press, in more detail a complex bench press that has the functions of a flat bench press, a decline bench press, and an incline bench press by adjusting the angle of the bench and is very conveniently and quickly switched, between the functions.

BACKGROUND ART

In general, bench presses have three functions of a flat bench press for developing the muscle of the middle portion of the chest, a decline press for developing the muscle of the lower portion of the chest, and an incline press for developing the muscle of the upper portion of the chest, and individual bench presses having one function and complex bench presses having the three functions have been known, First, the individual bench presses have no problem to be used for developing the muscles of the middle portion, the lower portion, and the upper portion of the chest, as shown in FIGS. 1, 2, and 3, but the purchase cost increases because it is required to purchase a flat bench 2*a* (see FIG. 1), a decline bench 2*b* (see FIG. 2), and an incline bench 2C (see FIG. 3), other than barbell presses 1. Further, considering the dimensions, generally, a width of 30, a length of 110, and a height of 40, of each of the benches 2*a*, 2*b*, 2*c*, too large space is required to install all of the benches 2*a*, 2*b*, 2*c* in a common home, A complex bench press, as shown in FIGS. 4, 5, and 6, one bench 3 is switched to a flat (see FIG. 4), a decline (see FIG. 5), or an incline bench press (see FIG. 6), such that it is advantageous in efficiently using a space; however, as shown in FIG. 5, when it is switched to a decline bench press, the user's waist too bends and may foe injured, when it is used as an incline bench press, as shown in FIG. 6, the distance between a bar 4 and a bench 3 is so small that the user have to lift the barbell from barbell supports 5 in an uncomfortable position or the arms turns not perpendicular to the ground when taking down the barbell on the barbell supports 5 after exercising; therefore, force is unnecessarily applied to the shoulders and arras of the user, such that the shoulders and arms may be injured.

Further, it is trouble and takes long time to switch the complex bench press to the flat, decline, or incline bench press, as compared with the individual bench presses. This is because eight steps, that is, removing the barbell from the barbell supports 5, loosening the bolts for adjusting the height of the barbell supports 5, lifting the bench 3, removing and installing bench support bars 5*a*, adjusting the position of the barbell supports 5, tightening the bolts for adjusting the height of the barbell supports 5, placing the bench 3 on the support bar 5*a*, and placing the barbell on the barbell supports 5, are required no switch a bench press having a predetermined function to a bench press having another function.

As a result, there are two problems that the purchase cost is increased by purchasing benches and a relatively large space is required in comparison to the complex bench press, when individual bench presses of the related art are used to achieve the three functions of flat, decline, and incline bench presses, while there are two problems that the exerciser is easily injured and takes unnecessary time to switch the positions, when the complex bench press is used.

DISCLOSURE

Technical Problem

The present invention has been made to solve the problems of the related art and it is an object of the present invention to provide a complex bench press which can be switched into a flat bench press, a decline bench press, or an incline bench press to achieve improved space utilization in a narrow space, and which enables users to switch the bench press into the bench press for a specific function in a significantly simple and quick manner to achieve improved convenience of use, and which enables users to always take an appropriate position for exercising even when the bench press is switched into the bench press for a specific function, thereby protecting users from injury during exercise.

Technical Solution

In order to achieve the object of the present Invention, a complex bench press according to the present invention includes: a bench; barbell supports coupled to the bench via first rotary shaft such that one side of the bench is rotatable at a predetermined angle in the upward and downward directions; a vertical driving cylinder installed, on a base arranged below each barbell support to move the barbell support in the upward and downward directions by extending and retracting a cylinder rod thereof; a cylinder-driving unit which applies working-pressure to the cylinder rod of the vertical driving cylinder such that the cylinder rod extends and retracts; bench supports coupled to the bench via second rotary shaft such that the other side of the bench is rotatable at a predetermined angle in the upward and downward directions; and bench-moving members installed beneath the bench supports.

Further, the complex bench press further includes height adjustment means disposed between the bench supports and the bench-moving members to vertically move the bench supports, Further, the complex bench press further includes wheels coupled to the lower portions of the bench-moving members in contact with the ground.

Further, in the complex bench press, the cylinder-driving unit includes: a working pressure-applying cylinder that is connected with the vertical driving cylinder by a hose and supplies or removes working pressure to the vertical driving cylinder by forward/backward movement of a cylinder rod; and a straight motion mechanism that moves the cylinder rod forward/backward by converting rotational motion of an electric motor into straight reciprocation motion.

Further, in the complex bench press, the height adjustment means includes a height adjustment bar vertically fixed to the bench-moving member and inserted in the bench support, a plurality of adjustment holes is vertically formed through the height adjustment bar, and a through-hole is formed through the bench support, such that the height of the bench is adjusted by inserting a fixing pin in the through-hole with any one of the adjustment holes which is aligned with the through-hole.

Advantageous Effect

According to the present invention having the features described above, since it is possible to switch one bench to a fiat, decline, or incline bench press by using the vertical driving cylinder, cylinder-driving unit, and height adjustment unit installed at the bench supports, it is possible to efficiently use a space in a common home because the bench press does not occupy a large space. Further, since the barbell supports are vertically moved by working pressure of air or oil, it is possible to quickly and conveniently switch the bench press to have a specific function without a large force, even with the barbell on the barbell supports.

Further, according to the present invention, since the entire bench is inclined in a decline bench press, it is possible no prevent a user from being injured by excessive bending of the waist. Further, since the bench and the barbell supports are lifted together even if it is switched to an inclination bench press, the distance between the bar and the bench is always maintained at a predetermined level, similar to the fiat or decline bench press, such that it is possible to prevent the shoulders and arms from being injured when lifting up or moving down the barbell in an uncomfortable position due to very small distance between the bar and the bench when switching a bench press to the inclination bench press in the related art.

REFERENCE NUMERALS

| | |
|---|---|
| 10: | Bench |
| 11, 12: | First and second rotary shaft |
| 20: | Bench support |
| 21: | Base |
| 22: | Vertical driving cylinder |
| 23: | Hose |
| 30: | Bench support |
| 31: | Bench-moving member |
| 32: | Wheel |
| 33: | Height adjustment bar |
| 34: | Fixing pin |
| 40: | Cylinder-driving unit |
| 41: | Working pressure-applying cylinder |
| 42: | Electric motor |
| 43: | Straight motion mechanism |
| 51: | Input unit |

BEST MODE

Figure 1:
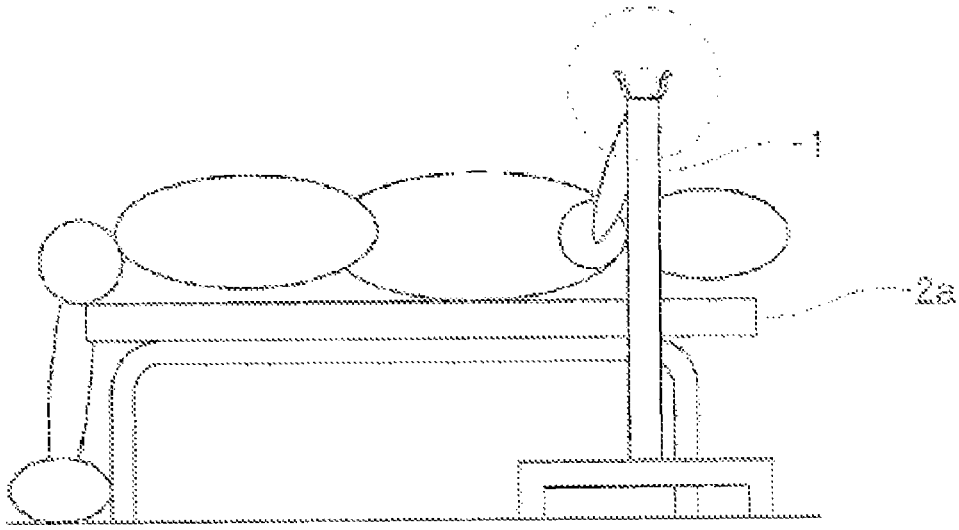
FIGS. 1 to 3 are views showing the configuration of an individual bench press of the related art.
Figure 2:
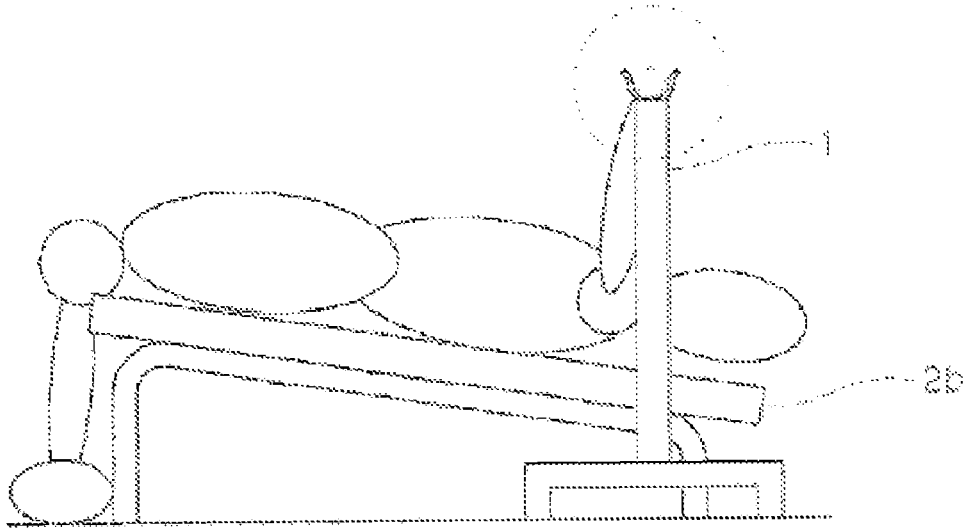
Figure 3:
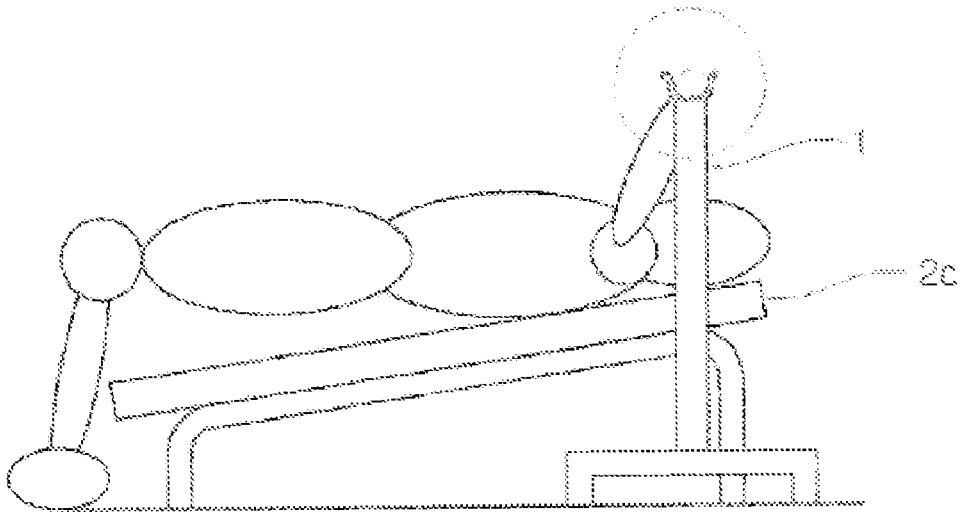
Figure 4:
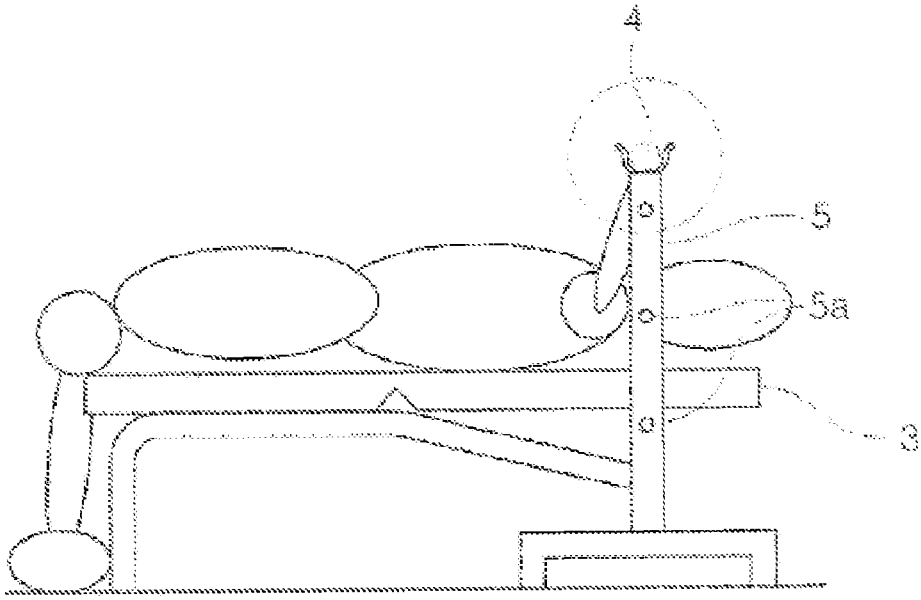
FIGS. 4 to 6 are views showing the configuration of a complex bench press of the related art.
Figure 5:
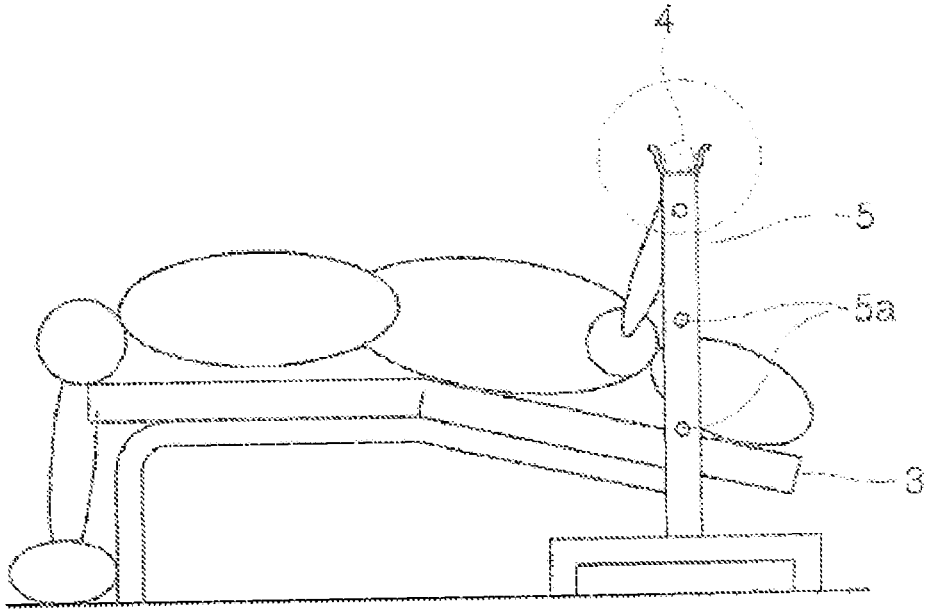
Figure 6:
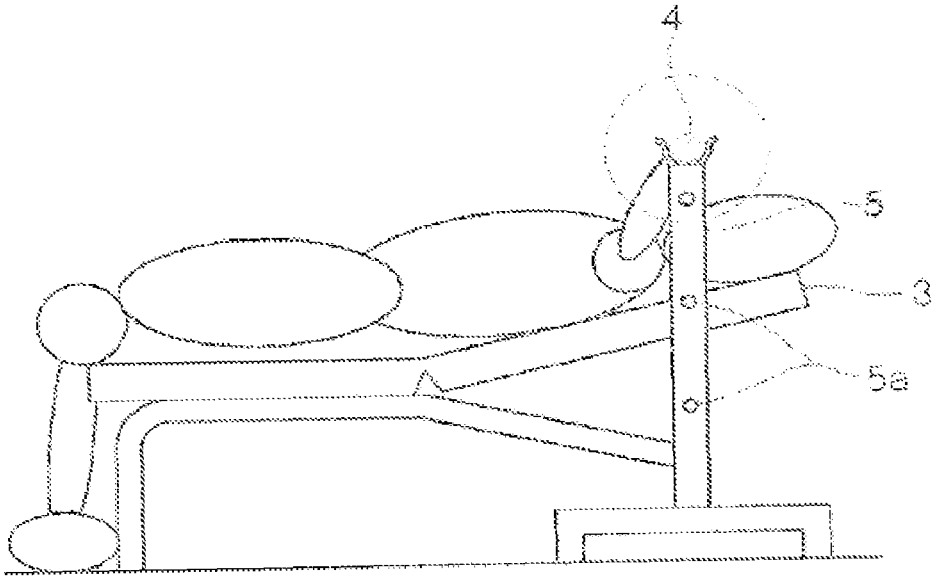
Figure 7:
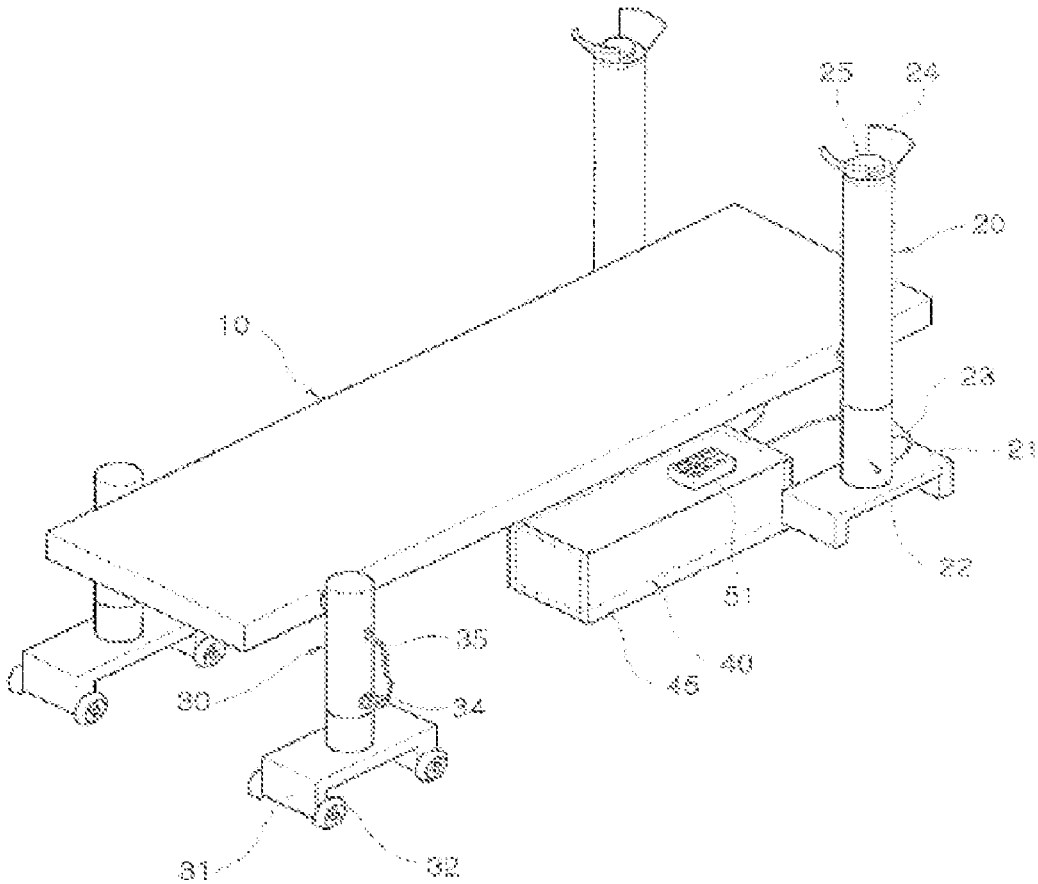
FIG. 7 is a perspective view showing a complex bench press according to the present invention.
Figure 8:
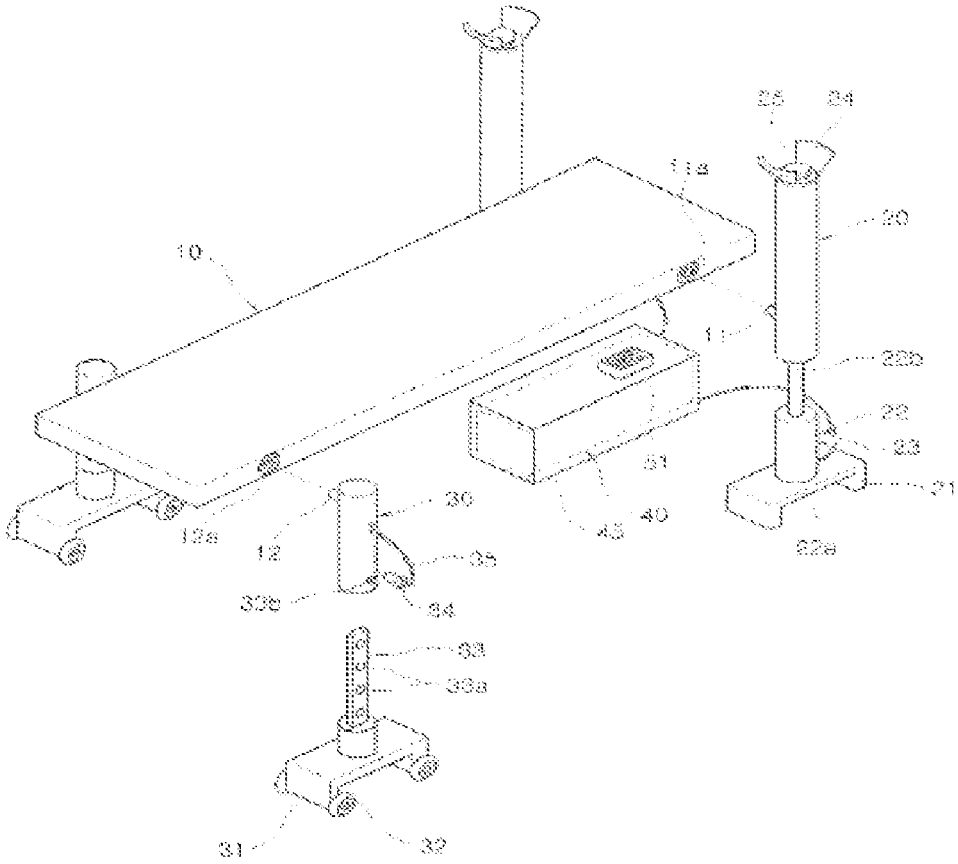
FIG. 8 is a partial exploded perspective view showing the complex bench press according to the present invention.

Hereinafter, preferred embodiments of the present invention will be described in detail with reference to the accompanying drawings. FIG. 7 is a perspective view showing the configuration of a complex bench press according to the present invention and FIG. 8 is a partial exploded perspective view showing the configuration of the complex bench press according to the present invention. As shown in the figures, a bench 10 where a user lies is provided, barbell supports 20 are fastened to one side, where the user's head is placed, of the bench 10 by first rotary shaft 11, and bench supports 30 are fastened to the other side, where the user's legs are placed, of the bench 10 by second, rotary shaft 12.

One side of the bench 10 can be vertically rotated at a predetermined angle with respect to the barbell supports 20 by the first rotary shaft 11, while the other side of the bench 10 can be vertically rotated with respect to the bench supports 30 by the second rotary shaft 12, In this configuration, it is preferable to install bearings 11*a*, 12*a* between the first and second rotary shaft 12 and the bench 10 in order to allow the bench 10 to smoothly rotate.

Further, bases 21 supporting and fixing one side of the bench 10 against the ground are disposed under the barbell supports 20 and vertical driving cylinders 22 vertically moving the barbell supports 20 are disposed on the bases 21.

Figure 9:
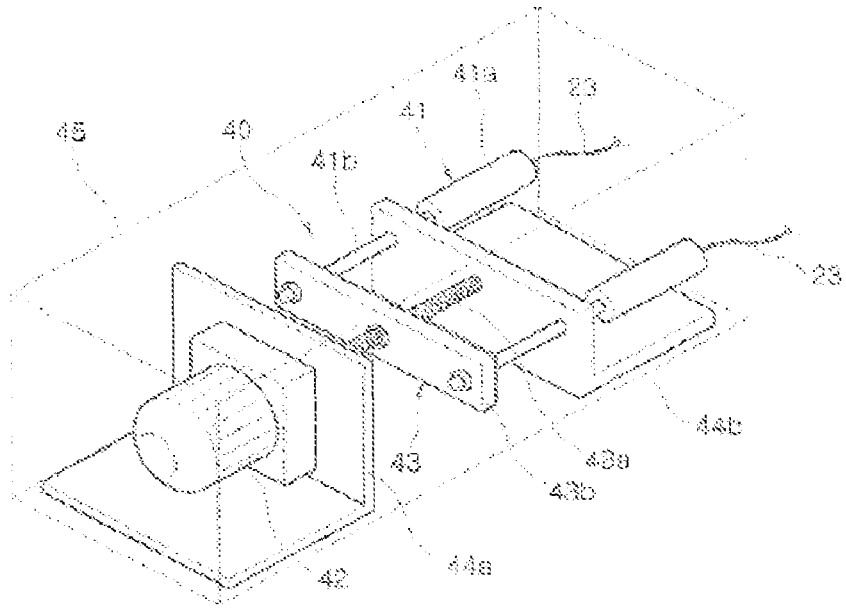
FIG. 9 is a perspective view showing a cylinder-driving unit of the complex bench press according to the present invention.

The vertical driving cylinder 22 is installed by fixing a cylinder body 22*a* to the base 21 and fixing a cylinder rod 22*b* to the barbell supports 20, the cylinder rod 22*b* moves into/out of the cylinder body 21*a* by working pressure from the fluid (air or oil) in the cylinder body 22*a* to vertically move the barbell support 20 such that the height of the side of the bench can be adjusted, The working pressure exerted in the vertical driving cylinder 22 is applied by a cylinder-driving unit 40. The cylinder-driving unit 40, as shown in FIGS. 9, 10, and 11, has a working pressure-applying cylinder 41 composed, of the cylinder body 41*a* filled with the fluid and the cylinder rod 41*b*, The cylinder body 22*a* of the vertical driving cylinder 22 and the cylinder body 41*a* of the working pressure-applying cylinder 41 are connected by a hose such that the fluid can flow therebetween.

Further, the cylinder rod 41*b* of the working pressure-applying cylinder 41 is moved into/out of the cylinder body 41*a* by a straight motion mechanism 43, which converts the rotational motion of an electric motor 41 into a reciprocating motion, to generate working pressure by sending the fluid therein to the vertical driving cylinder 22. The straight motion mechanism 43 is composed of the electric motor 42 installed by rotatably fixing a bolt shaft 43*a* to both fixing plates 44*a*, 44*b* and a moving block 43*b* thread-fastened to the bolt shaft 43*a*, and the cylinder rod 22*b* of the working pressure-applying cylinder 41 is fixed to the moving block 43*b* through one fixing plate 44*b*.

Figure 10:
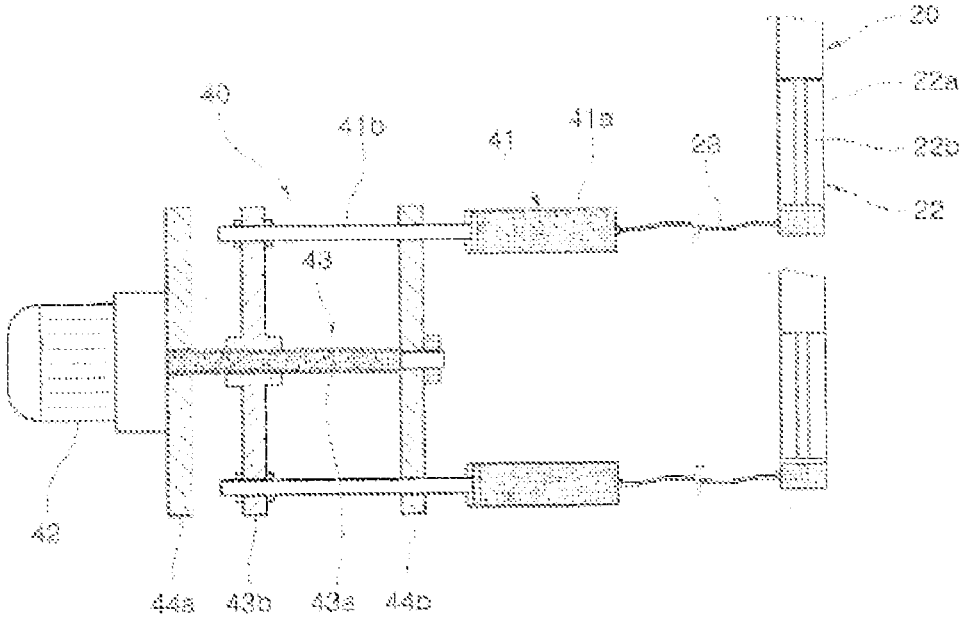
FIGS. 10 and 11 are cross-sectional views showing the operation of the cylinder-driving unit in the complex bench press according to the present invention.
Figure 11:
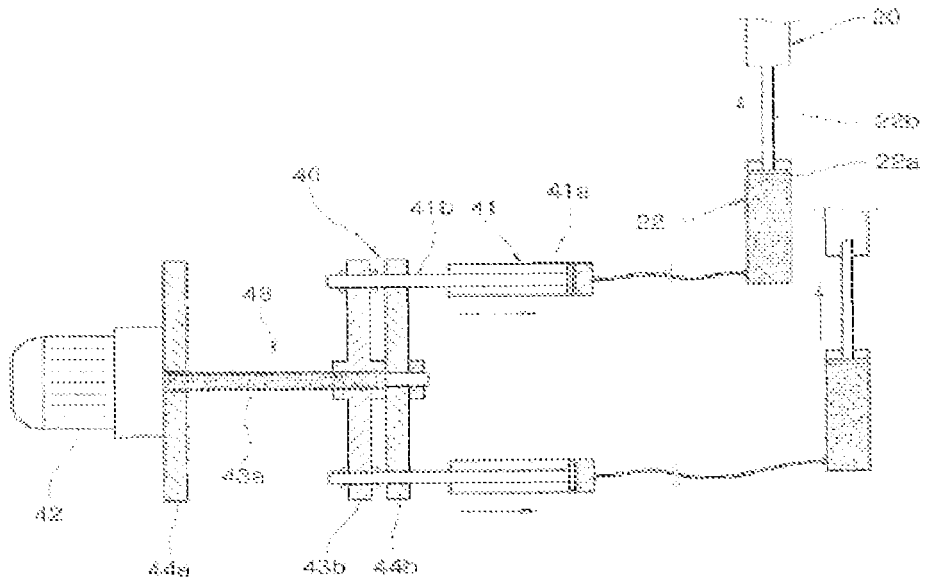

Therefore, as shown in FIGS. 10 and 11, as the electric motor 42 operates in normal and reverse directions and the bolt shaft 43*a* rotates, the moving block 43*b* reciprocates straight as much as the amount of rotation of the electric motor 42 and the cylinder rod 41*b* of the working pressure-applying cylinder 41 which is fixed to the moving block moves into/out of the cylinder body 41*a*, such that the fluid in the cylinder body 41*a* is supplied and collected to the cylinder body 22*a* of the vertical driving cylinder 22 which is connected by the hose 23, Accordingly, the cylinder rod 22*b* of the vertical driving cylinder 22 moves into/out of the cylinder body 22*a* and vertically moves the barbell supports 20, thereby adjusting the height of the bench 10.

The straight reciprocation distance of the moving block 43*b* depends on the amount of rotation of the electric motor 42, in the cylinder-driving unit 40 having the configuration described above, and the movement distance of the cylinder rod 22*b* of the vertical driving cylinder 22 and the working pressure-applying cylinder 41 depends on the movement distance of the moving block, such that it is possible to adjust the height of the barbell supports 20. It is preferable that the cylinder-driving unit 40, as shown in FIG. 8, is disposed in a protective case 45 to achieve a good external appearance.

Figure 12:
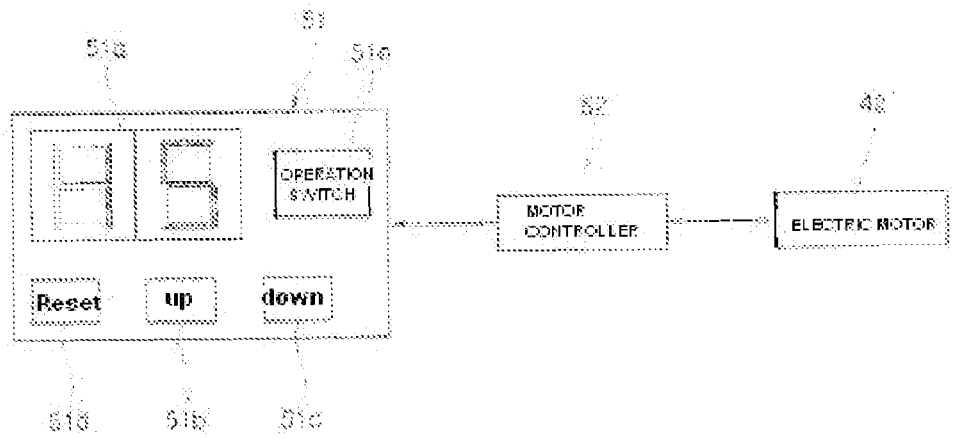
FIG. 12 is a view showing the configuration of a motor control unit in the complex bench press according to the present invention.

FIG. 12 is a view showing the configuration of the motor control unit that controls the amount of rotation of the electric motor 42 of the cylinder-driving unit 40, in which the motor control unit is composed of an input unit 51 for setting the inclination angle of the bench 10 and a motor controller 52 for controlling the inclination angle of the bench 10 by controlling the amount of rotation of the electric motor 42 on the basis of an inclination angle inputted from the input unit 51, The input unit 51 is composed of a display 51*a* for displaying the inclination angle, up/down switches 51*b*, 51*c* for increasing/decreasing the inclination angle displayed on the display 51*a*, a reset switch 51*d* for setting the inclination angle displayed on the display 51*a* always at 0°, which is the position of a flat bench press, and an operation switch 51*e* for operating the electric motor 42 to the inclination angle displayed, on the display 51*a*, It is preferable that the input unit 51 is installed to be easily operated by a user, for example, at the protective case 45 of the cylinder-driving unit 40, as shown in FIG. 8, Therefore, when the user selects and sets an inclination angle displayed on the display by using the up/down switches 51*b*, 51*c* and the reset switch 51*d* and then presses the operation switch 51*e*, the motor controller 52 operates the electric motor 42 while controlling the amount of rotation to correspond to the input inclination angle, such that the bench 10 can be positioned at the set inclination angle.

Figure 13:
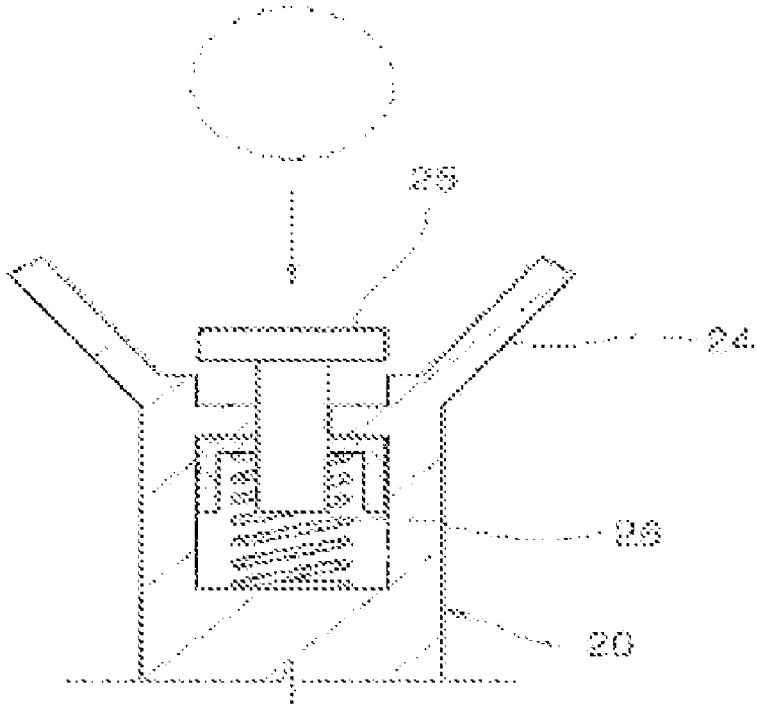
FIGS. 13 and 14 are views showing the configuration of a barbell shock-absorbing unit in the complex bench press according to the present invention.
Figure 14:
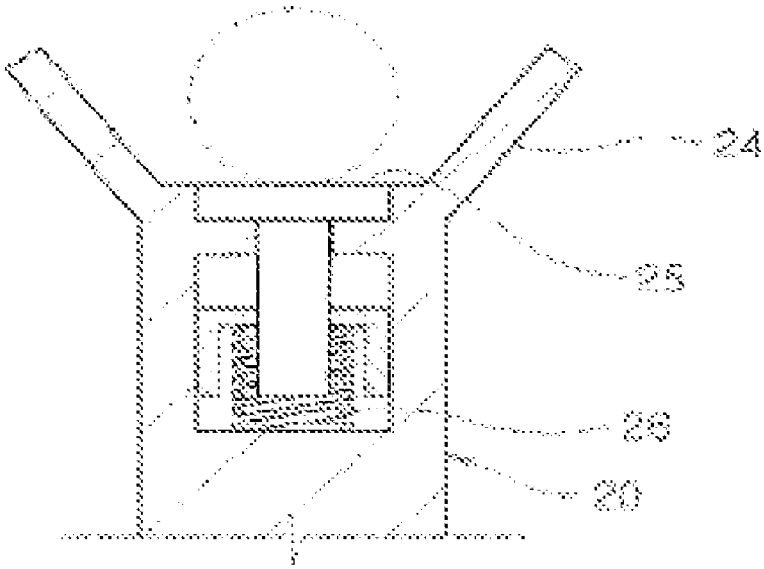

FIGS. 13 and 14 are views showing a shock-absorbing unit an a barbell holder 24 formed on the upper end of the barbell support 20, in which a barbell-seating plate 25 is disposed at the upper end of the barbell support 20, elastically by a spring 26, to absorb shock when the barbell is placed in the barbell holder 24 of the barbell support 20.

Referring to FIG. 7, bench-moving members 31 are disposed under the bench supports 30 at the other side of the bench 10. The bench-moving member 31 is equipped with wheels 32 being in contact with the ground and a height adjustment means is disposed between the bench support 30 and the bench-moving member 31 to adjust the height by vertically moving the bench support 30.

The height adjustment means has a height adjustment bar 33 vertically fixed to the bench-moving member 31 and inserted in the bench support 30, a plurality of adjustment holes 33*a* is vertically formed in the height adjustment bar 33, and a through-hole 33*b* is formed in the bench support 30, such that it is possible to adjust the height of the bench 10 by inserting a fixing pin 34 in the through-hole 33*b* and any one of the adjustment holes 33*a*, which is aligned with the through-hole. In this configuration, it is preferable to connect the fixing pin 34 to the bench support 30 with a bendable connecting member to easily keep it.

Figure 15:
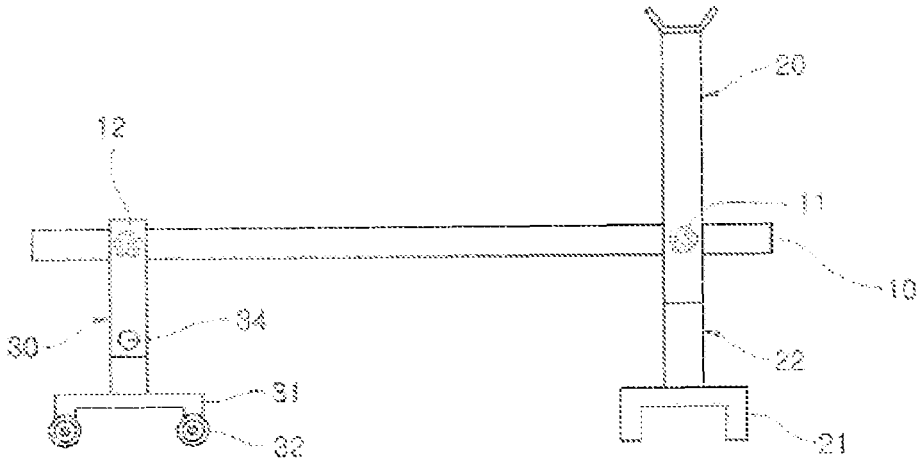
FIGS. 15 to 17 are views showing the use of the bench press according to the present invention.

The operation of the present invention having this configuration is described hereafter. First, FIG. 15 is a front view showing a flat bench press, in which the bench 10 is kept horizontal, such that a user can develop the muscle of the middle portion of the chest.

Figure 16:
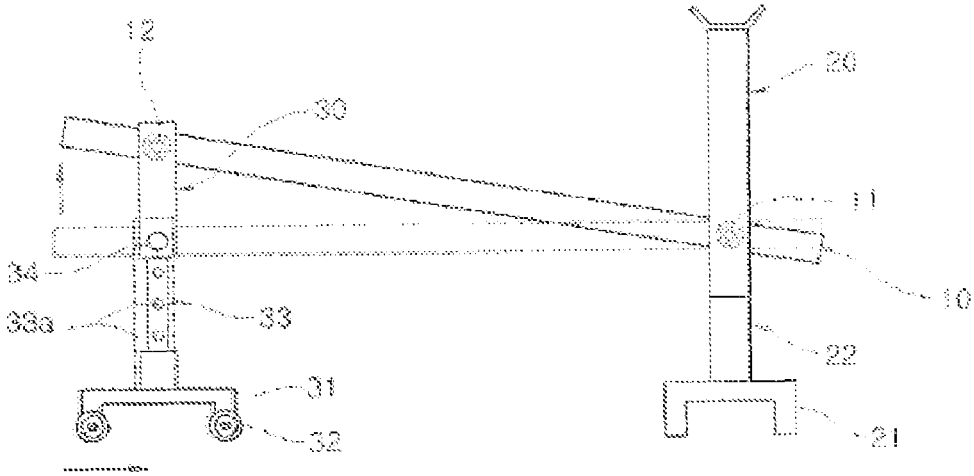
Figure 17:
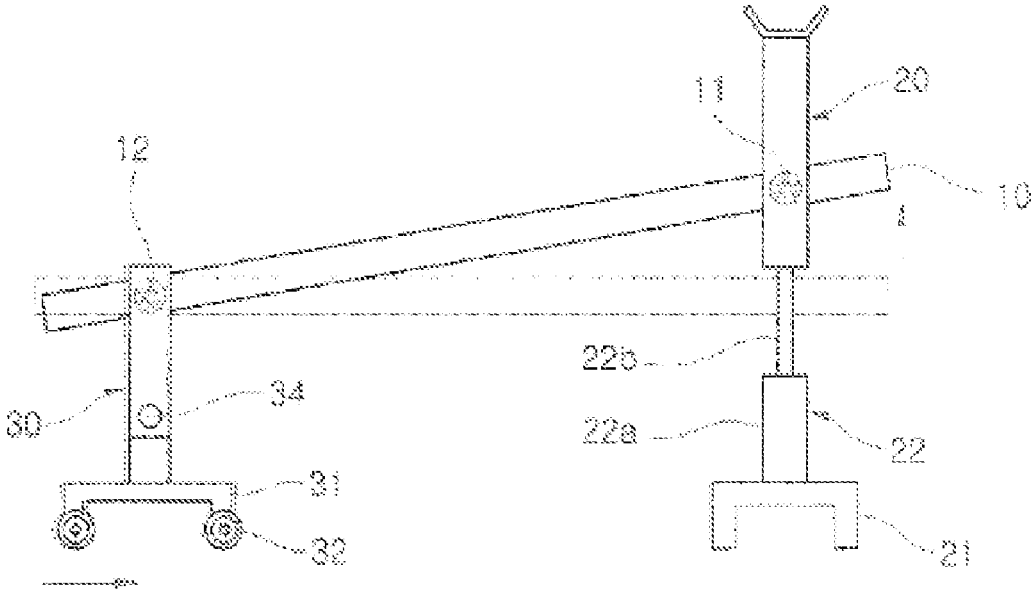

In order to switch the flat bench press to a decline bench press for developing the muscle of the lower portion of the chest, as shown in FIGS. 8 and 16, as the user pulls out the fixing pin 34 fixing support 30 and the height adjustment bar 33 and lifts the bench 10, the bench 10 is rotated at a predetermined distance upward about the head-sided first rotary shaft 11, Thereafter, when the user aligns the adjustment holes 33*a* of the height adjustment bar 33 with the through-hole 33*b* of the bench support 30 and inserting the fixing pin 34 for fixing, the flat bench press can be simply switched to the decline bench press.

In this state, since the position of the head side of the bench 10 is fixed with the barbell supports 20 by the first rotary shaft 11, the bench supports 30 are relatively rotated at a predetermined angle about the second rotary shaft 12 in proportion to the lifted amount of the bench 10 and pulled to the head side, but they are smoothly moved by the wheels 32 of the bench-moving members 31 under the bench supports 30.

As described above, since the inclination angle of the bench 10 can be variously adjusted and the entire bench 10 is inclined, when it is switched to the decline bench by selecting any one of the adjustment hole 33*a* of the height adjustment bar 33, it is possible to prevent the user from being injured due to excessive bending of the waist.

Thereafter, when switching the bench press to an incline bench press to develop the muscle of the upper portion of the chest, the user returns the bench press to the flat bench press, as shown in FIG. 15, and moves up the barbell supports 20 by operating the cylinder-driving unit 40, thereby simply performing the switching.

For example, as shown in FIG. 12, when the user adjusts the inclination angle displayed on the display 51*a* to a desired value by selectively pressing the up/down switches 51*b*, 51*c* of the input unit 51, the value is inputted to the motor controller 52, and then the user presses the operation switch 51*e*, the motor controller 52 operates the electric motor 42 of the cylinder-driving unit 40 while controlling the amount of rotation as much as the inclination angle corresponding to the input value, such that the bench supports 30 are moved up and the bench 10 can be positioned at the inclination angle selected by the user.

That is, as shown in FIGS. 10 and 11, as the electric motor 42 is operated, the threaded-shaft 43*a* rotates and moves the moving block 43*b* thread-fastened thereto as much as the amount of rotation of the electric motor 42 in the direction of an arrow of FIG. 11, and accordingly, the cylinder rod 41*b* of the working pressure-applying cylinder 41 fixed to the moving block 43*b* is inserted into the cylinder body 41*a* and sends the fluid in the cylinder body 41*a* into the cylinder body 22*a* of the vertical driving cylinder 22 through the hose 23.

Accordingly, the cylinder rod 22*b* of the vertical driving cylinder 22 is pushed, and protrudes out of the cylinder body 22*a* by the working pressure generated by the fluid flowing into the cylinder rod 22*b* of the vertical driving cylinder 22, such that the barbell supports 20 is lifted up and the bench 10 can be simply switched, to the incline bench press. In this position, since the head side of the bench 10 is fastened to the barbell supports 20 by the first rotary shaft 11 and the barbell supports 20 are fixed by the bases 21, the leg-sided bench supports 30 are pulled to the head side in proportion to the lifted amount of the bench 10 and are smoothly moved by the wheels 32 of the bench-moving members 31 under the bench supports 30.

As described above, the user can set the inclination of the incline bench press, using the input unit 51 and the motor controller 52 can lifts the barbell supports 20 as much as the inclination angle set by the user by controlling the amount of rotation of the electric motor 42, such that it is possible to very quickly and simply switch the bench press to the incline bench press and adjust the inclination angle, thereby achieve convenient use.

Further, according to the present invention, since the bench 10 and the barbell supports 20 are lifted, together even if it is switched to the incline bench press, the distance between the bar and the bench 10 is maintained at a predetermined value, similar to the flat or decline bench press, such that it is possible to prevent the shoulders and arms from being injured when lifting up or moving down the barbell in an uncomfortable position due to too small distance between the bar and the bench, when switching the bench press to the inclination bench press.

Further, in order to switch the incline bench press to the flan bench press, as shown in FIG. 15, when the reset switch 51*d* of the input unit 51 is pressed, the inclination angle of 0° is displayed on the display 51*a*, and then, when the electric motor 42 is operated by pressing the operation switch 51*e*, the bench 10 can be simply positioned in the flat bench press.

As described above, according to the complex bench press of the present invention, since it is possible to very quickly and conveniently adjust the inclination angle of the bench while switching the bench press to a flat, decline, or incline bench press, and particularly, working pressure of fluid is applied when it is switched to the incline bench press, it is possible to simultaneously lift up a heavy barbell. Therefore, it does not need to take down and then place the heavy barbell when switching the bench press to the incline bench press. Further, since the barbell and the barbell supports 20 are simultaneously lifted, the distance between the bar and the bench 10 can be maintained always at a predetermined level, it is possible to prevent the shoulders and arms from being injured when lifting up or moving down the barbell in an uncomfortable position due to very small distance between the bar and the bench when switching a bench press to the inclination bench press in the related art.

The embodiment described above is a preferred embodiment of the present invention and the spirit of the present invention is not limited to the embodiment described above. Further, the present invention may be changed and modified in various ways in the scope of the present invention and the following claims by those skilled in the art and the modified and changed embodiments should be construed as being included in the scope of the present invention,

INDUSTRIAL APPLICABILITY

The present invention that removes defects of the individual and complex bench presses can be useful for people, because they are increasingly interested in health and exercise.

The invention claimed is:

1. A complex bench press comprising:

a bench;

barbell supports coupled to the bench via first rotary shaft such that one side of the bench is rotatable at a predetermined angle;

a vertical driving cylinder installed on a base arranged below each barbell support to move the barbell support in the upward and downward directions by extending and retracting a cylinder rod thereof;

a cylinder-driving unit which applies working pressure to the cylinder rod of the vertical driving cylinder such that the cylinder rod extends and retracts;

bench supports coupled to the bench via second rotary shaft such that the other side of the bench is rotatable at a predetermined angle; and bench-moving members installed beneath the bench supports.

2. The complex bench press according to claim 1, further comprising height adjustment means disposed between the bench supports and the bench-moving members to vertically move the bench supports.

3. The complex bench press according to claim 1, further comprising wheels coupled to the lower portions of the bench-moving members in contact with the ground.

4. The complex bench press according to claim 1, wherein the cylinder-driving unit includes:

a working pressure-applying cylinder that is connected with the vertical driving cylinder by a hose and supplies or removes working pressure to the vertical driving cylinder by forward/backward movement of a cylinder rod; and a straight motion mechanism that moves the cylinder rod forward/backward by converting rotational motion of an electric motor into straight reciprocation motion.

5. The complex bench press according to claim 4, further comprising a motor control means for controlling the amount of rotation of the electric motor of the cylinder-driving unit, wherein the motor control unit includes an input unit for setting an inclination angle of the bench, and a motor controller controlling the amount of rotation of the electric motor on the basis of the inclination angle inputted from the input unit.

6. The complex bench press according to claim 2, wherein the height adjustment means includes a height adjustment bar vertically fixed to the bench-moving member and inserted in the bench support, a plurality of adjustment holes is vertically formed through the height adjustment bar, and a through-hole is formed through the bench support, such that the height of the bench is adjusted by inserting a fixing pin in the through-hole with any one of the adjustment holes which is aligned with the through-hole.

7. The complex bench press according to claim 1, further comprising a shock-absorbing unit that attenuates shock when a barbell is placed in barbell holders of the barbell supports.

8. The complex bench press according to claim 2, further comprising wheels coupled to the lower portions of the bench-moving members in contact with the ground.

* * * * *